US006739131B1

(12) United States Patent
Kershaw

(10) Patent No.: US 6,739,131 B1
(45) Date of Patent: May 25, 2004

(54) COMBUSTION-DRIVEN HYDROELECTRIC GENERATING SYSTEM WITH CLOSED LOOP CONTROL

(76) Inventor: Charles H. Kershaw, 10454 Norton, Houston, TX (US) 77043

( * ) Notice: Subject to any disclaimer, the term of this patent is extended or adjusted under 35 U.S.C. 154(b) by 0 days.

(21) Appl. No.: 10/324,373

(22) Filed: Dec. 19, 2002

(51) Int. Cl.[7] ..... F01B 29/00

(52) U.S. Cl. ..... 60/512; 91/4 R; 417/379; 417/381

(58) Field of Search ..... 60/508, 512, 325, 60/398; 417/379, 381; 91/4 R

(56) References Cited

U.S. PATENT DOCUMENTS 3,611,723 A * 10/1971 Theis, Jr. ..... 60/327
3,815,555 A 6/1974 Tubeuf
4,103,490 A * 8/1978 Gorlov ..... 60/398
5,461,858 A * 10/1995 Johnson ..... 60/325
5,551,237 A * 9/1996 Johnson ..... 60/641.8
5,713,202 A 2/1998 Johnson

* cited by examiner

*Primary Examiner*—Hoang Nguyen
(74) *Attorney, Agent, or Firm*—Kenneth A. Roddy

(57) ABSTRACT

A combustion-driven hydroelectric generating system has one or more combustion cylinders that contain a liquid (such as water) and receive a combustible fuel/oxidizer mixture that is ignited and the explosive force of the combustion acts on the surface of the liquid to transfer a metered slug of the liquid to a pressurized vessel containing a pressurized gas (preferably an inert gas). The pressurized liquid from the pressurized vessel serves as a "head of water" that can be used to operate a water wheel (Pelton wheel) or hydroelectric generator and perform other useful work. The transferred liquid is replaced in the combustion cylinders, another charge of the fuel/oxidizer is introduced and ignited and the process is repeated. Replacement liquid is introduced into the combustion cylinders through a closed loop system utilizing the exhaust of the combustion cycles to significantly lower the elapsed time period of each single cycle, and increases the production of power, efficiency of operation, and reliability.

21 Claims, 4 Drawing Sheets

COMBUSTION-DRIVEN HYDROELECTRIC GENERATING SYSTEM WITH CLOSED LOOP CONTROL

BACKGROUND OF THE INVENTION

1. Field of the Invention

This invention relates generally to the production of hydroelectric power, and more particularly to a combustion-driven hydroelectric generating system wherein a combustible fuel mixture is introduced and ignited in one or more combustion cylinders containing a liquid and the force of the combustion acts on the surface of the liquid to transfer a slug of the liquid to a gas pressurized vessel and the pressurized liquid from the vessel is used to operate a hydroelectric generator and perform other useful work.

2. Brief Description of the Prior Art

Electrical generation companies normally operate on a power grid system, wherein numerous individual power plants of the fossil fuel type, nuclear type, or the like are joined together over common transmitting lines. The electricity is usually generated using rotating generating equipment. Most electrical power generating facilities in the United States, at the present time, utilize a gas turbine generator as a prime power source for generating electricity that operates on a combustible fuel, usually natural gas, but some employ gas obtained by coal gasification or liquid fuel in vapor form.

Another frequently employed means for generating electricity is a hydraulic turbine generator utilizing the energy of the head of an elevated supply of water. Commonly, the electrical generation and distribution industry also utilizes pump-back facilities which store energy in the form of water head, utilizing energy during the periods when it is most readily and economically available and when surplus generating capacity exists, and recovering the energy to meet peak load demands. Typically, these pumpback facilities use electrical power to drive a generator which, when energized, functions as an electric motor, to power the turbines which, when driven, function as a pump, to move water from a lower elevation through a penstock to an upper elevation, usually an elevated lake. When the flow of water is reversed, the turbine drives the generator to recover the energy. A substantial amount of energy is required to move the water to the upper location and thus the recovered energy is always less than the amount of energy required to move the water to the upper elevation.

Johnson, U.S. Pat. No. 5,713,202 discloses an apparatus for generating hydroelectric power comprising a first tank and a second tank each connected by respective pipes to a power plant for conducting combustion products away from the power plant and into the top portion of the tanks above the liquid contained therein. The lower end of each tank is connected by ducts to a high pressure water storage tank. The water storage tank is connected by pipes to direct a stream of water onto a Pelton wheel or turbine. The spent water flows down by gravity into the first and second tanks through ducts.

Tubeuf, U.S. Pat. No. 3,815,555 discloses a hydraulic heat engine that operates in a submerged body of water. The heat engine has an upright cylinder which receives water from the body of water in which it is submerged through a one-way valve. A fuel mixture enters an expansion chamber at the upper end of the cylinder and is combusted. The liquid leaving the expansion chamber is propelled down and out from a lower part of the cylinder and transmitted into a first transfer chamber of another cylinder having at least two pistons secured to a piston rod that rotatably drives an output shaft. The return stroke of the piston rod moves the second piston on the piston rod in a second transfer chamber to push a fresh supply of liquid therefrom into the upright cylinder. Fluid from a supply is admitted to the second transfer chamber during the second piston's down stroke and fluid from the first transfer chamber is exhausted during the first piston's return stroke. A control device such as a cam arrangement driven by the output shaft controls valving in the conduits to regulate the supply of expansible propellant and the flow of liquid during the operating cycle.

Liquid piston engines of the type taught by Johnson and heat engines taught by Tubeuf have been in existence for many years. Most of these types of systems have serious deficiencies. One deficiency is low power output, even though the single explosion results in a large energy pulse. The total time required to inject the combustible mixture, to fire it, to displace the pulse of water may only be a few seconds, however, the time required to refill the cylinder may be much longer. Thus, the power level consisting of energy pulses per second is significantly low. Another deficiency is the loss of energy of each pulse when the exhaust is vented to atmosphere. This equates to the (manifold pressure) X (explosion cylinder volume) on the ideal gas with no heat loss.

My previous U.S. Pat. No. 6,182,615, which is hereby incorporated by reference to the same extent as if fully set forth herein, discloses a combustion-driven hydroelectric generating system that utilizes first and second combustion cylinders that contain a liquid (such as water) and receive a combustible fuel/oxidizer mixture that is ignited and the explosive force of the combustion acts on the surface of the liquid to transfer a metered slug of the liquid from the first and second combustion cylinders in alternating cycles into a pressurized vessel containing a pressurized gas (preferably an inert gas). The pressurized liquid from the pressurized vessel serves as a "head of water" that can be used to operate a water wheel (Pelton wheel) or hydroelectric generator and perform other useful work. The transferred liquid is replaced in the combustion cylinder, another charge of the fuel/oxidizer is introduced and ignited and the process is repeated. A fluid transfer cylinder divided into first and second chambers by a movable piston is used to increase the rate at which liquid is conducted into the first and second combustion cylinders, wherein its first and second chambers are alternately filled with replacement liquid at a first rate between combustion cycles of one of the first and second combustion cylinders and discharged into the other one of the first and second combustion cylinders at a greater rate.

The present invention has some features that are described in my previous patent and also contains significant improvements and features not disclosed in the previous patent. Although my previous patent has an improved cycle rate, the present invention incorporates a closed loop system that significantly lowers the elapsed time period of each single cycle, and increases the production of power, efficiency of operation, and reliability.

The present invention is distinguished over the prior art in general, and these patents in particular, by a combustion-driven hydroelectric generating system that utilizes one or more combustion cylinders that contain a liquid (such as water) and receive a combustible fuel/oxidizer mixture that is ignited and the explosive force of the combustion acts on the surface of the liquid to transfer a metered slug of the liquid to a pressurized vessel containing a pressurized gas (preferably an inert gas). The pressurized liquid from the pressurized vessel serves as a "head of water" that can be used to operate a water wheel (Pelton wheel) or hydroelectric generator and perform other useful work. The transferred liquid is replaced in the combustion cylinders, another charge of the fuel/oxidizer is introduced and ignited and the process is repeated. Replacement liquid is introduced into the combustion cylinders through a closed loop system utilizing the exhaust of the combustion cycles to significantly lower the elapsed time period of each single cycle, and increases the production of power, efficiency of operation, and reliability.

SUMMARY OF THE INVENTION

It is therefore an object of the present invention to provide a combustion-driven hydroelectric generating system that utilizes readily available fuel and liquid products to produce hydroelectric power inexpensively.

It is another object of this invention to provide a combustion-driven hydroelectric generating system for use as an emergency power supply to provide hydroelectric power during power outages and when existing power sources are unavailable.

Another object of this invention is to provide a combustion-driven hydroelectric generating system having fuel and pressure requirements that can be served from existing plant or domestic drops from natural gas pipelines.

Another object of this invention is to provide a combustion-driven hydroelectric generating system that produces and stores energy in the form of pressurized water that is used as a head of water to operate a hydroelectric power generating apparatus without having to move the water to an upper location and is not dependent upon being located near a lake or reservoir.

Another object of this invention is to provide a combustion-driven hydroelectric generating system that utilizes combustion cylinders to produce and store energy in the form of pressurized water that is used as a head of water to operate a hydroelectric power generating apparatus wherein replacement liquid is introduced into the combustion cylinders through a closed loop system utilizing the exhaust of the combustion cycles to significantly lower the elapsed time period of each single cycle, and increases the production of power, efficiency of operation, and reliability.

Another object of this invention is to provide a combustion-driven hydroelectric generating system that is suitable for individual domestic residential use and for large-scale commercial use to provide hydroelectric power.

Another object of this invention is to provide a combustion-driven hydroelectric generating system that is non-polluting when operating on natural gas.

Another object of this invention is to provide a combustion-driven hydroelectric generating system that does not require a muffler and has low-noise emission.

A further object of this invention is to provide a combustion-driven hydroelectric generating system that has a minimum of moving parts and is reliable in operation.

A still further object of this invention is to provide a combustion-driven hydroelectric generating system that is inexpensive to manufacture, operate, and maintain.

Other objects of the invention will become apparent from time to time throughout the specification and claims as hereinafter related.

The above noted objects and other objects of the invention are accomplished by a combustion-driven hydroelectric generating system that has one or more combustion cylinders that contain a liquid (such as water) and receive a combustible fuel/oxidizer mixture that is ignited and the explosive force of the combustion acts on the surface of the liquid to transfer a metered slug of the liquid to a pressurized vessel containing a pressurized gas (preferably an inert gas). The pressurized liquid from the pressurized vessel serves as a "head of water" that can be used to operate a water wheel (Pelton wheel) or hydroelectric generator and perform other useful work. The transferred liquid is replaced in the combustion cylinders, another charge of the fuel/oxidizer is introduced and ignited and the process is repeated. Replacement liquid is introduced into the combustion cylinders through a closed loop system utilizing the exhaust of the combustion cycles to significantly lower the elapsed time period of each single cycle, and increases the production of power, efficiency of operation, and reliability.

DESCRIPTION OF THE PREFERRED EMBODIMENTS

In a basic form, the combustion-driven hydroelectric generating system comprises one or more combustion cylinders that contain a liquid (such as water) and receive a combustible fuel/oxidizer mixture that is ignited and the explosive force of the combustion acts on the surface of the liquid to transfer a metered slug of the liquid to a pressurized vessel containing a pressurized gas (preferably an inert gas such as nitrogen or argon). The products of combustion in the combustion cylinders are vented to the atmosphere either directly or via thermal and/or pressure scavengers. The pressurized liquid from the pressurized vessel serves as a "head of water" that can be used to operate a water wheel (Pelton wheel) or hydroelectric generator and perform other useful work. The transferred liquid is replaced in the combustion cylinder, another charge of the fuel/oxidizer is introduced and ignited and the process is repeated.

Figure 1:
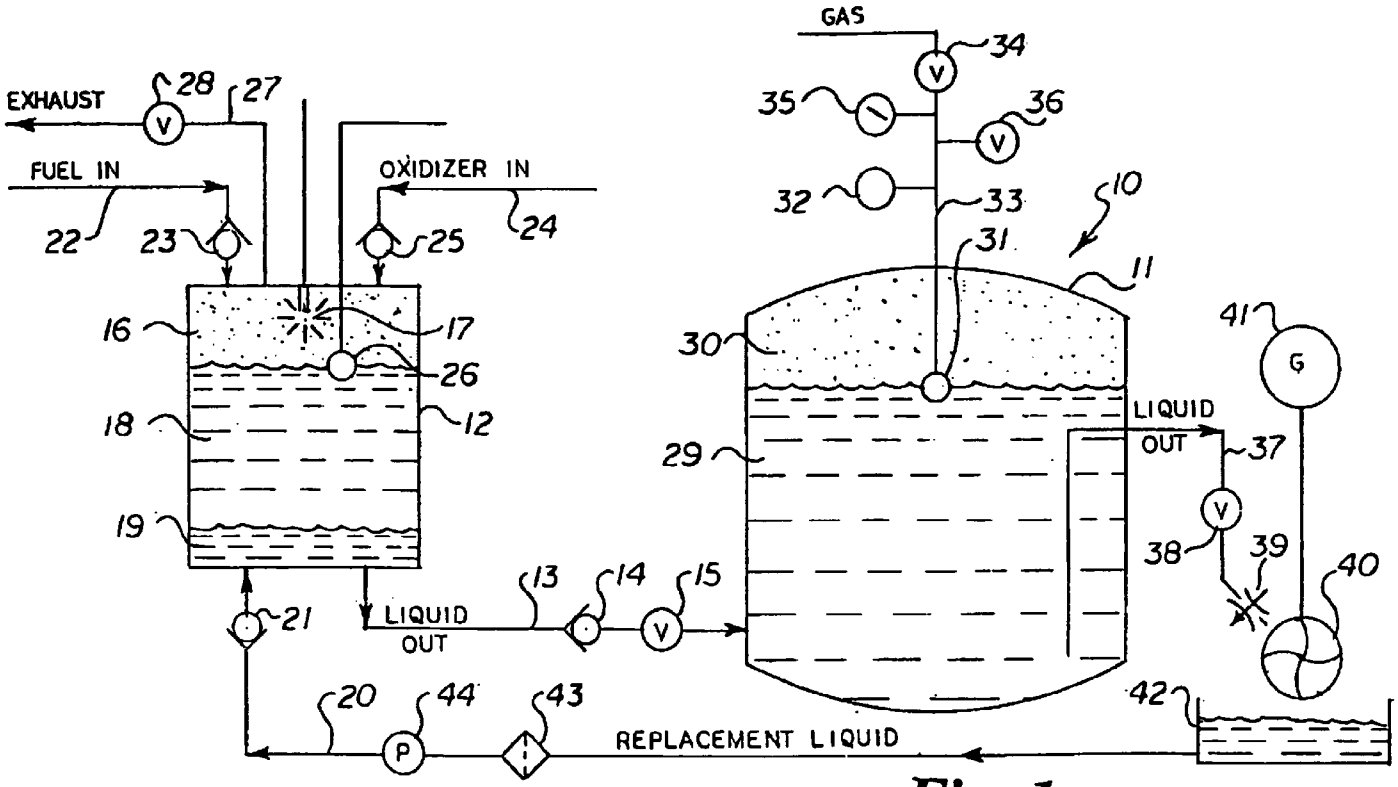
FIG. 1 is a schematic diagram of the combustion-driven hydroelectric generating system in accordance with the present invention.

Referring to the drawings by numerals of reference, there is shown schematically in FIG. 1, a preferred combustion-driven hydroelectric generating system 10. A pressure vessel 11 is connected to one or more combustion cylinders 12 by a liquid supply line 13 that conducts a high-pressure liquid from the combustion cylinder 12 to the vessel 11 though a series connected check valve 14 and shut-off valve 15. There may be any number of combustion cylinders 12 feeding the vessel 11, such as via a plenum or manifold so that one may be filling while another is firing. For efficiency purposes, the fuel mixture and/or the cylinder itself may be heated by waste heat.

Each combustion cylinder 12 has an upper section 16 that holds a combustible charge of a fuel/oxidizer mixture and is equipped with a firing apparatus 17, such as a spark plug, glow plug, or other suitable igniter. A battery and contractor or other suitable source (not shown) may accomplish ignition of the firing apparatus 17. An intermediate section 18 of the combustion cylinder 12 holds a volume of liquid that is to be passed to the vessel 11 under pressure exceeding the pressure in the vessel during combustion. The lower section 19 holds the liquid that is remaining after the shot or combustion. Replacement liquid is introduced into the lower end of the combustion cylinder 12 via line 20 and check valve 21, as described hereinafter.

A suitable fuel, such as a combustible gas (preferably natural gas), and a suitable oxidizer, such as air may be introduced separately into the combustion cylinder 12 via fuel line 22 and check valve 23, and oxidizer line 24 and check valve 25, respectively, and mixed inside the cylinder. Alternatively, the fuel and oxidizer may be mixed outside the cylinder and introduced as a mixture.

A liquid level sensor 26 senses the liquid level in the upper section 16 and, at a different cycle time, the liquid level in lower section 19, or there may be separate sensors for each level. By use of a computer or microcontroller which controls the amount of combustible charge, these level signals maintain the maximum slug of high-pressure liquid and also prevent transferring products of combustion to the upper section of the pressurized vessel 11.

The products of combustion, after firing, are released from the combustion cylinder 12 through exhaust line 27 and exhaust valve 28. Additional apparatus such as thermal and/or pressure scavengers may be connected with the exhaust line 27 to recover excess heat and pressure. Since some fuel, air or products of combustion may dissolve in the high pressure liquid slug and become transferred to the vessel 11, a processing loop may be used to remove those gases. A suitable membrane may also be disposed in the combustion cylinder 12 at the interface between the fuel/oxidizer mixture and the liquid to prevent products of combustion from becoming mixed with the liquid.

The pressurized vessel 11 contains a volume of the liquid in a lower section 29, and a compressed gas, preferably an inert gas such as nitrogen or argon, is contained in an upper section 30 above the liquid. If the liquid is devoid of combustible gas, compressed air may be used. The interface between the gas and liquid is sensed by a liquid level transducer 31, and is maintained between maximum and minimum levels by computer control (not shown). The pressure in the vessel 11 is sensed by a pressure transducer 32, which is used to maintain a constant pressure in the vessel, for example 150 PSI. The inert gas is introduced into the vessel 11 through a manifold 33 equipped with a manual gas filling valve 34, a pressure gauge 35, and a safety relief valve 36. The liquid level transducer 31 may also be connected with the manifold 33. A suitable membrane may be disposed in the pressurized vessel 11 at the interface between the gas and the liquid to prevent gases from becoming mixed with the liquid.

The liquid from the pressurized vessel 11 is conducted via a working line 37 equipped with a shut-off valve 38 and a throttle valve 39, which conducts the high-pressure liquid to a hydroelectric water wheel 40 (Pelton wheel) and generator 41. The high pressure liquid output may also be used for purposes other than generating electricity. For example, it may pump water or gas via a separating membrane, a piston, or other device and may be pressure intensified. In short, it acts as a general pumping source.

Replacement liquid after passing over the water wheel 40 is collected in a catchment trough or reservoir 42 and conducted via replacement liquid line 20 through a filter 43 and is pumped by pump 44 into the lower section of the combustion cylinder 12 through check valve 21. Optionally, flow and pressure transducers (not shown) may monitor the replacement liquid. A liquid make-up apparatus may be used at the catchment trough or reservoir 42 to offset the normal loss of liquid to the atmosphere if the system is operated as a closed liquid cycle but not a closed air cycle.

In a preferred embodiment, a computer or microcontroller (not shown) is used to control the timing of firing cycles, the volume of, and pressure applied to, each liquid slug, the fuel mixture/liquid interface levels in the combustion cylinders 12 and the pressurized gas/liquid interface levels in the pressurized vessel 11 such that the electric generator or other end use of the liquid's energy is maintained at predetermined speed and power levels. This function is also facilitated by the throttle valve 39. The computer or microcontroller also meters the appropriate combustion mixture and make-up (replacement) liquid.

In the absence of early opening of valve 28, the firing cycle of the combustion cylinder 12 is as follows. The combustion cylinder 12 is loaded with a metered liquid charge, as described above. A metered amount of the combustible fuel/oxidizer mixture at the appropriate pressures is introduced into the upper section 16 of the combustion cylinder 12. The igniter 17 is fired, and the pressure in the combustion cylinder 12 rises rapidly to a peak, as does the temperature. Then both drop less rapidly to the pressure and equilibrium temperature of the pressurized vessel 11. Finally, the remaining combustion cylinder pressure drops below the pressure of the pressurized vessel 11 due to further cooling of the remaining products of combustion.

The explosive force in the combustion cylinder 12 during combustion acts on the surface of the liquid to transfer a metered slug of the liquid to the pressurized vessel 11 containing the pressurized gas. The products of combustion in the combustion cylinder 12 are vented to the atmosphere. The pressurized liquid from the pressurized vessel 11 is used as a "head of water" that can operate a water wheel (Pelton wheel) and/or hydroelectric generator to perform useful work. The transferred liquid is replaced in the combustion cylinder 12, another charge of the fuel/oxidizer mixture is introduced and ignited and the process is repeated.

Figure 2:
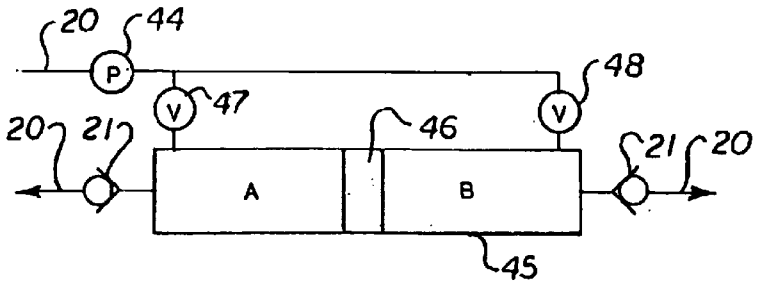
FIG. 2 is a schematic diagram showing a piston cylinder that may be connected with the hydroelectric generating system to produce useful work.

FIG. 2 shows a free or coupled piston cylinder 45 that can be used to perform a number of optional services when there are multiple combustion cylinders 12. For example, left and right chambers A and B divided by a moving piston 46 can be filled, in turn, through computer controlled valves 47 and 48 with a metered liquid slug at a slow pace between firings, then pushed rapidly into the appropriate combustion cylinder to decrease the cycle time. Motive force for the operation of the piston 46 may be supplied directly from a take-off shaft connected with the water wheel 40 or by utilizing the exhaust pressure of a prior cycle. During the water replacement phase of the cycle, valve 28 is open to atmosphere, so that pump 44 is not working against an increasing back pressure. Similarly, another piston and cylinder or even the same piston and cylinder may supply the fuel/oxidizer required by the combustion cylinders.

Figure 3:
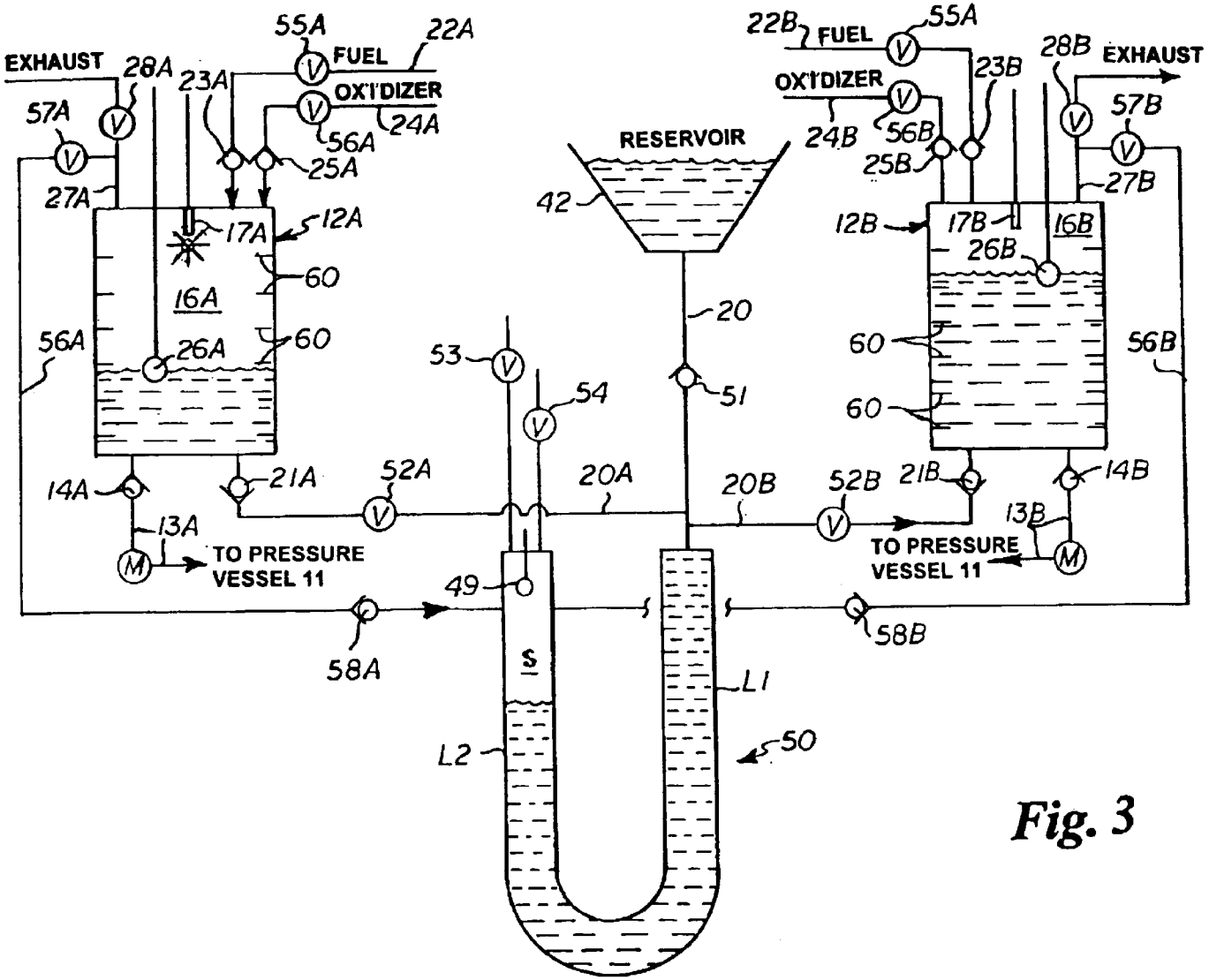
FIG. 3 is a schematic diagram of a pair of combustion cylinders connected in a closed loop system that utilizes the exhaust of the combustion cycles to replace liquid and lower the elapsed time period of each single cycle and increase the production of power, efficiency of operation, and reliability.
Figure 4:
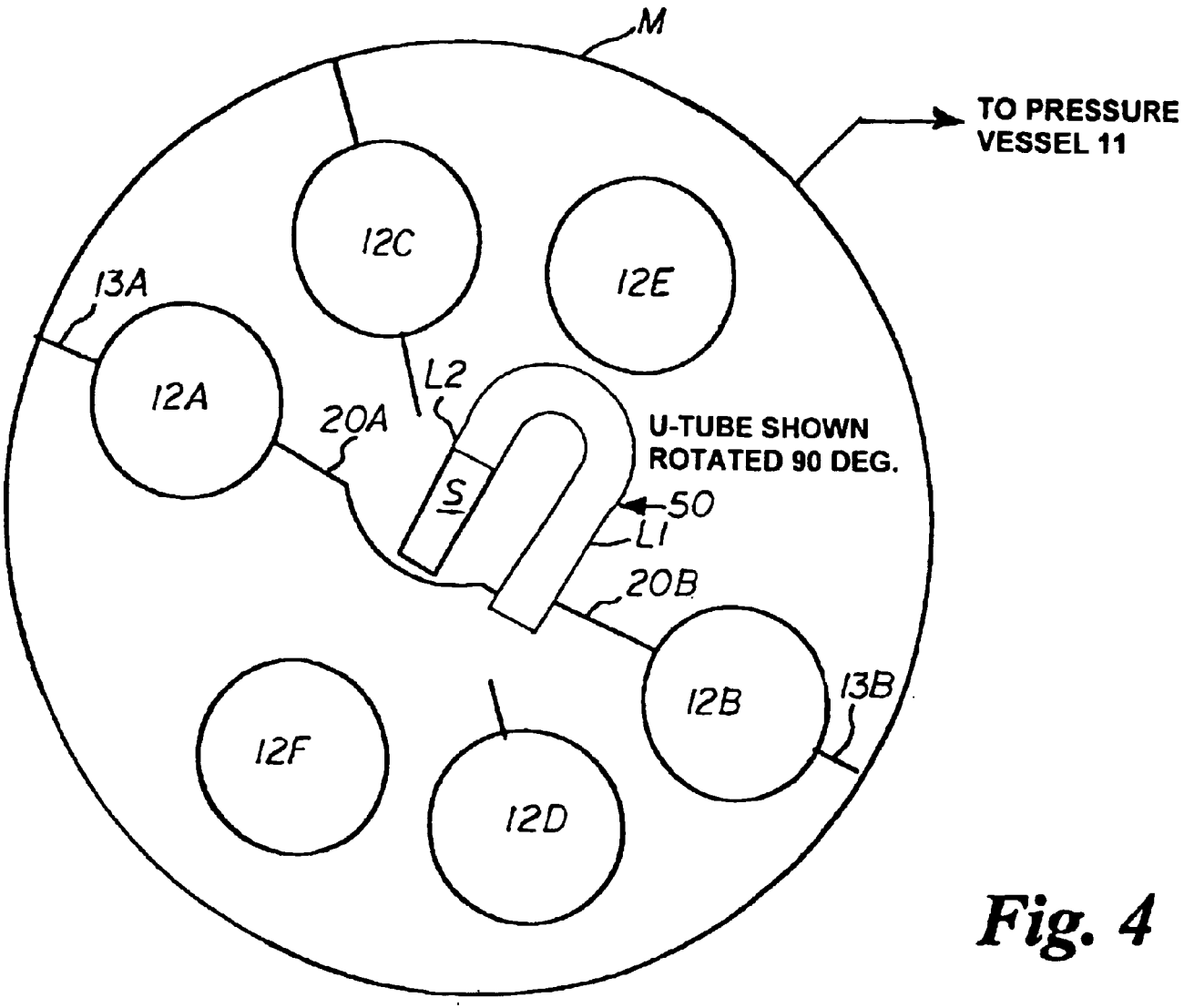
FIG. 4 is a schematic diagram of a plurality of combustion cylinders connected by a common manifold in a closed loop system that utilizes the exhaust of the combustion cycles to replace liquid.

FIGS. 3 and 4 show, schematically, a closed loop system that significantly lowers the elapsed time period of each single cycle and increases the production of power, efficiency of operation, and reliability. This is another embodiment of a transfer system, which specifically utilizes some or all of the exhaust gas pressure.

In the arrangement shown in FIG. 3 and 4, two of the combustion cylinders 12A and 12B, as described above are shown. The same reference numerals are used to designate the same components as described previously, but their detailed description will not be repeated again to avoid repetition. For purposes of explanation and ease of understanding, the letter A is used to designate the components associated with a first combustion cylinder 12A and letter B is used to designate the components associated with a second combustion cylinder 12B.

The combustion cylinders 12A and 12B are each connected to the pressure vessel 11, as shown and described previously, via liquid supply lines 13A and 13B that conduct the high-pressure liquid from the combustion cylinders 12A, 12B, to the vessel 11 though respective check valves 14A, 14B. As described above, shut-off valves (not shown) may be provided in the liquid supply lines 13A, 13B between the check valves 14A, 14B and the pressure vessel 11. The liquid supply lines 13A, 13B may be joined to a common manifold M so that one cylinder may be filling while another is firing. It should be understood that any number of combustion cylinders may be used to feed the vessel 11 via the manifold.

Replacement liquid from the catchment trough or reservoir 42 is introduced into the lower end of the combustion cylinders 12A, 12B, through a U-tube 50. The catchment trough or reservoir 42 is connected to one leg L1 of the U-tube 50 via replacement liquid line 20 and check valve 51. The replacement liquid line 20 has branches 20A and 20B connected to the lower end of the combustion cylinders 12A, 12B, through check valves 21A and 21B and computer controlled valves 52A and 52B, respectively.

The other leg L2 of the U-tube 50 has a space S above the liquid level which is filled with air or gas. A computer controlled normally open valve 53 is connected to the top end of the leg L2 of the U-tube 50 such that the space S above the liquid level is open to the atmosphere anytime that no liquid transfer is taking place to allow refilling of the of the U-tube from the reservoir 42 via check valve 51. A liquid level sensor 49 at the upper end of leg L2 of the U-tube 50 is associated with the computer controlled normally open valve 53 to close the valve upon reaching a predetermined level. For initial cycle starting, and other possible re-fill adjustments, a computer controlled valve 54 is connected to the top end of the leg L2 to allow entry of high pressure air into the space S above the level of the liquid. In the embodiment of FIG. 3, the fuel, such as a combustible gas (preferably natural gas), and a suitable oxidizer (such as air), may be introduced separately into the combustion cylinders 12A and 12B through fuel lines 22A, 22B via computer controlled valves 55A and 55B and check valves 23A, 23B, and oxidizer lines 24A, 24B via computer controlled valves 56A and 56B and check valves 25A and 25B, respectively, and mixed inside the cylinder. Alternatively, the fuel and oxidizer may be mixed outside the cylinder and introduced as a mixture. The products of combustion, after firing, are released from the combustion cylinders 12A, 12B, through exhaust lines 27A, 27B, and computer controlled exhaust valves 28A and 28B, respectively.

Below the valves 28A, 28B, the exhaust lines 27A, 27B, are joined to the space S above the liquid level in leg L2 of the U-tube 50 via respective exhaust branch lines 56A and 56B containing computer controlled valves 57A and 57B and check valves 58A and 58B.

The firing cycle of the combustion cylinders 12A and 12B is as described previously and takes place in alternating cycles. A metered amount of the combustible fuel/oxidizer mixture at the appropriate pressures is introduced into the upper section 16A of the combustion cylinder 12A. The igniter 17A is fired, and the pressure in the combustion cylinder 12A rises rapidly to a peak, as does the temperature. The explosive force in the combustion cylinder 12A during combustion acts on the surface of the liquid therein to transfer a metered slug of the liquid to the pressurized vessel 11 containing the pressurized gas. The products of combustion in the combustion cylinder 12A may be vented to the atmosphere via controlled valve 28A, but normally, only after the process described below.

As shown in FIG. 3, when the controlled valve 28A is closed, controlled valve 57A in the exhaust branch line 56A is opened and the exhaust gas in cylinder 12A is exhausted through check valve 58A into the space S above the liquid in the leg L2 of the U-tube 50. At the same moment, the controlled valve 52A in the replacement liquid line 20A is closed preventing flow therethrough and the controlled valve 52B in the replacement liquid line 20B is opened and liquid is forced from the right leg L1 of the U-tube 50 through the check valve 21B into the lower end of the cylinder 12B. Also, simultaneously, the controlled exhaust valve 28B in the exhaust line 27B is opened to allow the liquid to fill the second cylinder 12B.

In the next phase of the cycle, controlled exhaust valve 28A is opened when liquid level sensor 26B has indicated complete transfer of liquid to the second cylinder 12B. In the event that liquid level sensor 26B indicates that complete transfer has not been attained, an auxiliary liquid feed (not shown) is activated to complete the filling of the cylinder. Normally, there will be a remnant exhaust gas in the first cylinder 12A, which is then exhausted via controlled exhaust valve 28A to atmosphere or further utilized.

Controlled valve 53, above the space S in the leg L2 of the U-tube 50, is normally open to allow gravity feeding of the U-tube via line 20 and check valve 51. The liquid level sensor 49 indicates when the leg L2 of the U-tube 50 is full and computer control closes the valve 53, to inhibit overflow of the U-tube.

To modulate the liquid and avoid sloshing during the refill cycles, the combustion cylinders 12A, 12B may be provided with anti-sloshing baffles 60, which are shown schematically.

It should be understood that the U-tube 50 may be configured as shown or with concentric legs and that it may feed a pair of cylinders 12A, 12B, as shown, or any other group of cylinders. For example, FIG. 4 shows six cylinders 12A through 12F ringing the U-tube 50 and joined by a common manifold M and feeding two of the cylinders 12A and 12B, but any other grouping is permissible. The purpose is to maximize efficiency by the lowest pressure drop and minimal heat loss.

It should also be understood that the combustion cylinders 12, 12A, 12B, may be provided with additional water level sensors, temperature sensors, flow sensors, and pressure sensors, as necessary.

Figure 5:
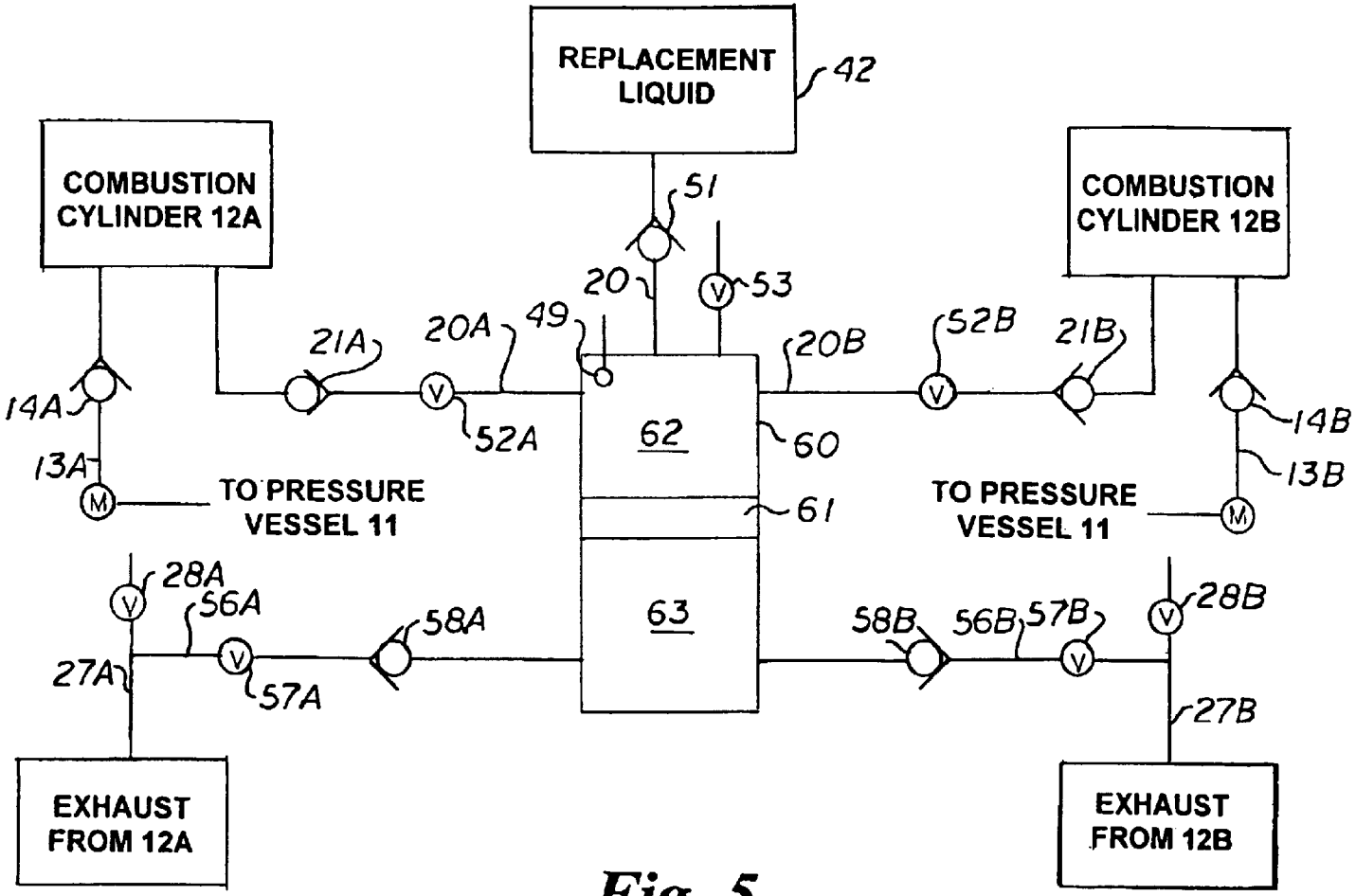
FIG. 5 is a schematic diagram of an alternate transfer cylinder that utilizes the exhaust of the combustion cycles to replace liquid and lower the elapsed time period of each single cycle and increase the production of power, efficiency of operation, and reliability.

Alternatively, FIG. 5 shows a free or coupled piston cylinder 60 that may be used in place of the U-tube in the closed loop system, which utilizes some or all of the exhaust gas pressure to significantly lower the elapsed time period of each single cycle and increase the production of power, efficiency of operation, and reliability. The cylinder 60 is connected with the replacement liquid source and with at least two of the combustion cylinders 12A and 12B, as shown and described above. The same reference numerals are used to designate the same components as described previously, but all of the components are not show and their detailed description will not be repeated again here to avoid repetition.

The cylinder 60 is divided by a moving piston 61 into a first and second chamber 62 and 63, respectively. Replacement liquid from the catchment trough or reservoir 42 is introduced into the first chamber 62 via replacement liquid line 20 and check valve 51. The first chamber 62 is connected to the lower end of the combustion cylinders 12A, 12B, via lines 20A and 20B and through check valves 21A and 21B and computer controlled valves 52A and 52B, respectively. The chamber 62 of the cylinder 60 may also be connected with a normally opened controlled valve 53 to allow gravity feeding via line 20 and check valve 51, and a liquid level sensor 49 to indicate when the chamber is full and close the valve 53 to inhibit overflow of the U-tube.

As described previously, the products of combustion, after firing, are released from the combustion cylinders 12A, 12B, through exhaust lines 27A, 27B, and computer controlled exhaust valves 28A and 28B, respectively. Below the valves 28A, 28B, the exhaust lines 27A, 27B, are joined to the second chamber 63 of the cylinder 60 via respective exhaust branch lines 56A and 56B containing computer controlled valves 57A and 57B and check valves 58A and 58B.

When the controlled valve 28A is closed, controlled valve 57A in the exhaust branch line 56A is opened and the exhaust gas in cylinder 12A is exhausted through check valve 58A into the second chamber 63 of the cylinder 60 beneath the piston 61. At the same moment, the controlled valve 52A in the replacement liquid line 20A is closed preventing flow therethrough and the controlled valve 52B in the replacement liquid line 20B is opened and liquid is forced from first chamber 62 of the cylinder 60 through the check valve 21B into the lower end of the cylinder 12B. Also, simultaneously, the controlled exhaust valve 28B in the exhaust line 27B is opened to allow the liquid to fill the second cylinder 12B.

In the next phase of the cycle, controlled exhaust valve 28A is opened when the liquid level sensor in the second combustion cylinder 12B has indicated complete transfer of liquid. In the event that liquid level sensor 26B indicates that complete transfer has not been attained, an auxiliary liquid feed (not shown) is activated to complete the filling of the cylinder. Normally, there will be a remnant exhaust gas in the first cylinder 12A, which is then exhausted via controlled exhaust valve 28A to atmosphere or further utilized. A metered amount of the combustible fuel/oxidizer mixture at the appropriate pressures is introduced into the upper section 16B of the combustion cylinder 12B, and the process is repeated.

Existing drops from natural gas pipelines, plant or domestic can adequately serve the pressure and volume requirements of the present system. The full power rating is available within seconds of a "grid" power failure, as distinct from the extended crank-up time on current emergency power supplies, and it is particularly suited for emergency electrical supply, for overloaded and escalating costs in black-out and brown-out conditions on the "grid", and for economic, peak hours feed-back to the grid.

The system is very quiet, relatively efficient and low polluting as compared to gasoline and diesel systems, and is capable of supplying non-propulsive loads in road vehicles, ships and military applications.

While this invention has been described fully and completely with special emphasis upon preferred embodiments, it should be understood that within the scope of the appended claims the invention may be practiced otherwise than as specifically described herein.

What is claimed is:

1. A process for generating hydroelectric power comprising the steps of:

providing first and second combustion cylinders containing a volume of liquid, a pressurized vessel containing a volume of gas under pressure connected with each combustion cylinder through valve means for discharging liquid from said first and second combustion cylinders into said pressurized vessel in alternating cycles, hydroelectric power generation means connected with said first and second combustion cylinders, liquid replacement means connected with said hydroelectric power generation means, and fluid transfer means connected with said liquid replacement means and said first and second combustion cylinders;

said fluid transfer means having a liquid chamber and a gas chamber, said liquid chamber connected with said liquid replacement means through valve means for receiving replacement liquid therefrom and having first and second liquid outlets connected with said first and second combustion cylinders through liquid metering valve means, respectively, said gas chamber having first and second liquid outlets connected with said first and second combustion cylinders through exhaust gas metering valve means, respectively;

alternately introducing a combustible fuel mixture into said first and second combustion cylinders above the volume of liquid therein and combusting the fuel mixture to forcefully transfer a portion of the volume of liquid from said first and second combustion cylinders into said pressurized vessel at a first rate, the liquid transferred to said pressurized vessel being pressurized by the volume of gas therein;

alternately introducing exhaust pressure from said first and second combustion cylinders into said gas chamber of said fluid transfer means during exhaust cycles to pressurize the liquid contained therein and discharging the liquid under pressure into said first and second combustion cylinders to alternately refill said first and second combustion cylinders with liquid between combustion cycles at a rate greater than said first rate at which the portion of the volume of liquid is transferred from said first and second combustion cylinders into said pressurized vessel; and conducting a portion of the pressurized liquid from the pressurized vessel to the hydroelectric power generation means for operating the hydroelectric power generation means to generate power.

2. The process according to claim 1, including the further step of:

conducting a portion of the liquid used to operate said hydroelectric power generation means to said liquid replacement means for supplying liquid to said fluid transfer means.

3. The process according to claim 1, wherein the liquid is water.

4. The process according to claim 1, wherein the gas contained in the pressurized vessel is an inert gas.

5. The process according to claim 4, wherein the inert gas contained in the pressurized vessel is selected from the group consisting of nitrogen, argon, and air.

6. The process according to claim 1, wherein said combustible fuel mixture is a mixture selected from the group consisting of a mixture of natural gas and air, and a mixture of hydrocarbon fuel and air.

7. The process according to claim 1, wherein the hydroelectric power generation apparatus comprises a Pelton wheel for generating electricity.

8. Apparatus for generating hydroelectric power, comprising:

first and second combustion cylinders for containing a volume of liquid each having a liquid inlet for receiving a liquid, a fuel mixture inlet for receiving a combustible fuel mixture, fuel ignition means, an exhaust outlet for exhausting pressure and products of combustion, and a liquid discharge outlet for discharging liquid therefrom;

a pressurized vessel for containing a volume of gas under pressure having a gas inlet for receiving a volume of gas, a liquid inlet connected with said first and second combustion cylinders liquid discharge outlet through valve means to receive liquid discharged therefrom in alternating cycles, and a liquid outlet;

hydroelectric power generation means operatively connected with said pressurized vessel liquid outlet for receiving liquid discharged from said pressurized vessel and generating power responsive thereto;

liquid replacement means for receiving a portion of the liquid from said hydroelectric power generation means;

a fluid transfer cylinder having a liquid chamber and a gas chamber, said liquid chamber connected with said liquid replacement means through valve means for receiving and containing a volume replacement liquid therefrom, and having first and second liquid outlets connected with a respective said liquid inlet of said first and second combustion cylinders through valve means for alternately supplying liquid thereto, and said gas chamber having first and second gas inlets connected with a respective said exhaust outlet of said first and second combustion cylinders through valve means for alternately receiving exhaust pressure therefrom; wherein a volume of gas is introduced into said pressurized vessel, a combustible fuel mixture is alternately introduced into said first and second combustion cylinders above the volume of liquid contained therein, said ignition means is activated to combust the fuel mixture to forcefully transfer a portion of the volume of liquid from said first and second combustion cylinders into said pressurized vessel at a first rate, the liquid transferred to said pressurized vessel being pressurized by the volume of gas therein;

exhaust pressure from said first and second combustion cylinders is alternately introduced into said gas chamber of said fluid transfer means during exhaust cycles to pressurize the liquid contained therein and the liquid is discharged under pressure into said first and second combustion cylinders to alternately refill said first and second combustion cylinders with liquid between combustion cycles at a rate greater than said first rate at which the portion of the volume of liquid is discharged from said first and second combustion cylinders into said pressurized vessel; and a portion of the pressurized liquid from said pressurized vessel is conducted to the hydroelectric power generation means for operating the hydroelectric power generation means to generate power.

9. The apparatus according to claim 8, wherein a portion of the liquid used to operate said hydroelectric power generation means is conducted to said liquid replacement means for supplying liquid to said fluid transfer means.

10. The apparatus according to claim 8, wherein said liquid is water.

11. The apparatus according to claim 8, wherein said gas contained in said pressurized vessel is an inert gas.

12. The apparatus according to claim 11, wherein said inert gas is comprised of the group consisting of nitrogen, argon, and air.

13. The apparatus according to claim 8, wherein said combustible fuel mixture is a mixture selected from the group consisting of a mixture of natural gas and air, and a mixture of hydrocarbon fuel and air.

14. The apparatus according to claim 8, further comprising:

controlled valve means connected with said gas chamber of said transfer cylinder to be normally open to atmosphere when no liquid transfer is taking place to facilitate refilling of said transfer cylinder from said liquid replacement means, and to be closed when receiving exhausted products of combustion to facilitate pressurizing the liquid in said transfer cylinder by exhaust pressure during exhaust cycles of said first and second combustion cylinders.

15. The apparatus according to claim 14, further comprising:

a liquid level sensor in said liquid chamber of said transfer cylinder associated with said controlled valve to close the normally open valve upon the liquid in said liquid chamber reaching a predetermined level.

16. The apparatus according to claim 14, further comprising:

a second controlled valve means connected with said gas chamber of said transfer cylinder operative to allow entry of high pressure air into to said gas chamber to facilitate initial cycle starting and refilling adjustments.

17. The apparatus according to claim 8, wherein said fluid transfer cylinder comprises a hollow generally U-shaped cylindrical tube having a first leg and a second leg extending upwardly from a U-shaped lower end;

said liquid chamber occupying said first leg, said U-shaped lower end, and a portion of said second leg; and said gas chamber occupying a portion of said second leg above the level of liquid therein.

18. The apparatus according to claim 8, wherein said fluid transfer cylinder comprises a hollow cylinder having a movable piston separating said liquid chamber and said gas chamber.

19. The apparatus according to claim 8, further comprising:

a plurality of baffles in each of said first and second combustion cylinders to modulate the liquid transfer and avoid sloshing during refill cycles.

20. A system for producing a head of liquid under pressure at different rates to be used for performing useful work, comprising:

first and second combustion cylinders for containing a volume of liquid each having a liquid inlet for receiving a liquid, a fuel mixture inlet for receiving a combustible fuel mixture, fuel ignition means, an exhaust outlet for exhausting pressure and products of combustion, and a liquid discharge outlet for discharging liquid therefrom;

a pressurized vessel for containing a volume of gas under pressure having a gas inlet for receiving a volume of gas, a liquid inlet connected with said first and second combustion cylinders liquid discharge outlet through valve means to receive liquid discharged therefrom in alternating cycles, and a liquid outlet; and a fluid transfer cylinder having a liquid chamber and a gas chamber, said liquid chamber connected with a source of replacement liquid through valve means for receiving and containing a volume replacement liquid therefrom, and having first and second liquid outlets connected with a respective said liquid inlet of said first and second combustion cylinders through valve means for alternately supplying liquid thereto, and said gas chamber having first and second gas inlets connected with a respective said exhaust outlet of said first and second combustion cylinders through valve means for alternately receiving exhaust pressure therefrom; wherein a volume of gas is introduced into said pressurized vessel, a combustible fuel mixture is alternately introduced into said first and second combustion cylinders above the volume of liquid contained therein, said ignition means is activated to combust the fuel mixture to forcefully transfer a portion of the volume of liquid from said first and second combustion cylinders into said pressurized vessel at a first rate, the liquid transferred to said pressurized vessel being pressurized by the volume of gas therein;

exhaust pressure from said first and second combustion cylinders is alternately introduced into said gas chamber of said fluid transfer means during exhaust cycles to pressurize the liquid contained therein and the liquid is discharged under pressure into said first and second combustion cylinders to alternately refill said first and second combustion cylinders with liquid between combustion cycles at a rate greater than said first rate at which the portion of the volume of liquid is discharged from said first and second combustion cylinders into said pressurized vessel; and a portion of the pressurized liquid from said pressurized vessel is conducted from said pressurized vessel to perform useful work.

21. The system according to claim 20, wherein a portion of the liquid used to perform useful work is conducted to said liquid replacement means for supplying liquid to said fluid transfer means.

* * * * *